United States Patent [19]

Matuura et al.

[11] Patent Number: 4,824,751

[45] Date of Patent: Apr. 25, 1989

[54] TONERS FOR ELECTROPHOTOGRAPHIC PROCESS CONTAINING CHROMIUM COMPLEX SALTS

[75] Inventors: Toshihiko Matuura, Okegawa; Kenzi Sawaki, Chiba; Seizin Shindo, Yono; Michiko Torigoe, Tokyo, all of Japan

[73] Assignee: Nippon Kayaku Kabushiki Kaisha, Tokyo, Japan

[21] Appl. No.: 79,717

[22] Filed: Jul. 30, 1987

[30] Foreign Application Priority Data

Aug. 4, 1986 [JP] Japan ..... 61-181863

[51] Int. Cl.[4] ..... G03G 9/08

[52] U.S. Cl. ..... 430/106; 430/110; 430/109

[58] Field of Search ..... 430/110, 106, 109

[56] References Cited

U.S. PATENT DOCUMENTS

| | | | |
|---|---|---|---|
| 4,070,296 | 1/1978 | Gibson et al. | 430/106 |
| 4,433,040 | 2/1984 | Niimura et al. | 430/110 X |
| 4,562,136 | 12/1985 | Inoue | 430/110 X |
| 4,563,409 | 1/1986 | Suzuki et al. | 430/110 |

FOREIGN PATENT DOCUMENTS

| | | |
|---|---|---|
| 20153 | 10/1966 | Japan . |
| 6397 | 11/1969 | Japan . |
| 35142 | 1/1981 | Japan . |
| 93457 | 7/1984 | Japan . |

*Primary Examiner*—J. David Welsh

*Attorney, Agent, or Firm*—Henry C. Nields

[57] ABSTRACT

A toner for an electrophotographic process which comprises a complex salt compound represented by the following formula (1)

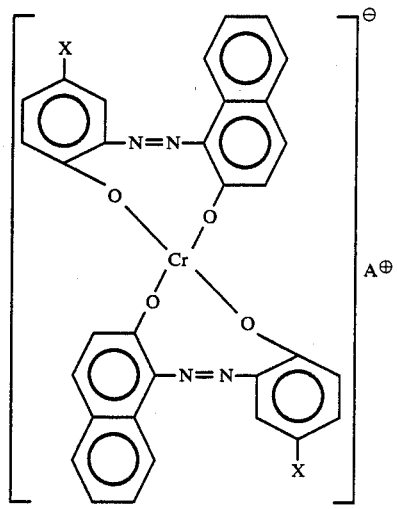

(1)

wherein X represents Cl, Br, $So_2NH_2$, $So_2CH_3$ or $So_2C_2H_5$ and A⊕ represents an alkenyl or alkylammonium ion of 17–28 carbon atoms. The complex salt compound of the formula (1) acts as a negative charge control agent in the toner and is good in compatibility with a binder and the toner prepared using it is excellent in specific chargeability and durability of charge.

7 Claims, No Drawings

TONERS FOR ELECTROPHOTOGRAPHIC PROCESS CONTAINING CHROMIUM COMPLEX SALTS

BACKGROUND OF THE INVENTION

1. Field of The Invention

This invention relates to toners for electrophotographic process. More particularly, it relates to toners for electrophotographic process which contain a specific complex salt compound.

2. Description of Prior Art

Electrophotographic (imaging) process referred to as xerographic imaging process or xerography are well known (U.S. Pat. No. 4,066,563, etc.).

General method for electrostatic image formation is as follows: That is, first, toners are charged by contact friction with glass beads, iron powders, aluminum powders, etc. called carriers, then these toners are allowed to develop an electrostatic latent image on a photoconductor comprising a photoconductive material (such as selenium, zinc oxide or cadmium sulfide) and the visible image thus obtained is fixed by heating or treating with solvents, vapor. Toners are usually composed of a binder as a main component and a charge control agent, a colorant, etc. and are pulverized to 1–50μ in particle size. Quality characteristics required for toners are chargeability, durability of charge (an ability to maintain a charge for a long time), flowability, etc. Especially, chargeability and durability of charge which have close relation with adherence property of toners to a transfer base (e.g., paper) are very important properties for image formation.

As positive charge control agents among charge control agents used in toners, there have been widely known nigrosine dyes, quaternary ammonium salts, pyridinium salts, etc. and as negative charge control agents, there have been widely known Cr, Co metal complex dyes, nitrohumic acid, etc. (cf. The Journal of Electrosatic Society, 1980, Vol. 4, No. 3, Page 144).

When Cr, Co metal complex dyes are used as negative charge control agents, chargeability reaches a tolerable level, but since these complex dyes are water-soluble, they are poor in compatibility with binders and the resulting toners are high in hygroscopicity and low in durability of charge. Thus, they are inferior in repetition property in image formation (copy).

Furthermore, toners disclosed in Japanese Patent Kokai (Laid-open) Nos. 93457/84 and 35142/81 are fairly improved in these properties, but are still insufficient in improvement of chargeability and durability of charge.

SUMMARY OF THE INVENTION

As a result of the inventor's intensive researches in an attempt to solve the above problems, this invention has been accomplished. That is, this invention provides toners for electrophotograhic process which comprise a complex salt compound represented by the following formula (1):

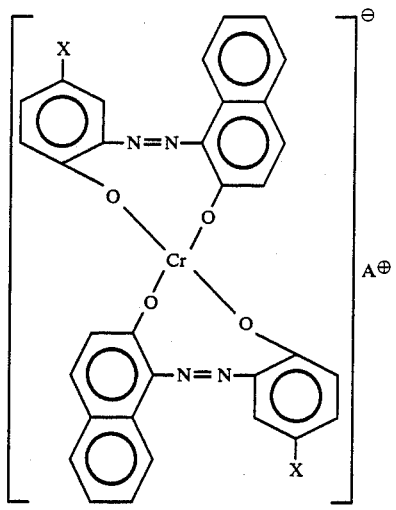

(1)

wherein X represents Cl, Br, $So_2NH_2$, $SO_2CH_3$ or $SO_2C_2H_5$ and A⊕ represents an alkenyl or alkylammonium ion of 17–28 carbon atoms.

DETAILED DESCRIPTION OF THE INVENTION

The complex salt compound of the formula (1) acts as a negative charge control agent and is good in compatibility with binder and toners prepared using it are high in specific chargeability and good durability of charge. Therefore, after storage of an extended period, they can provide stable and clear images in electrophotographic process (copy).

Toners containing a charge control agent are used in electrophotographic printing machines. Therefore, they are widely used in offices, etc. and often directly contact with human bodies through copied papers. Thus, requirement for hygienic safety in use of them is high. For example, charge control agents disclosed in Japanese Publication (Kokoku) Nos. 20153/66 and 26478/70 and Japanese Patent Kokai (Laid-open) No. 35142/81 did not give good results in mutagenic tests (Ames' Tests) and improvement in this respect has also been demanded. On the other hand, the complex salt compounds of the formula (1) gave good results in mutagenic tests and besides are superior in other properties required for charge control agents as mentioned above. Thus, this invention has remarkable industrial values.

The complex salt compounds represented by the formula (1) can be generally obtained by diazotizing amines such as 4-chloro-2-aminophenol, 4-bromo-2-aminophenol, 4-sulfoamido-2-aminophenol, 4-sulfomethyl-2-aminophenol, 4-sulfoethyl-2-aminophenol to obtain a diazonium salt, etc. by conventional methods, coupling the diazonium salt with β-naphthol to obtain a monoazo dye, complexing this monoazo dye with chromium by conventional methods and then subjecting the product to salt-forming treatment with $C_{17-28}$ alkenyl- or alkylamines such as heptadecylamine, octadecylamine, nonadecylamine, eicosylamine, heneicosylamine, docosylamine, tricosylamine, tetracosylamine, pentacosylamine, hexacosylamine, oleylamine, heptacosylamine, octacosylamine, etc. More preferably complex salt compounds among the compound represented by the formula (1) are ones represented by the following formula (1)'

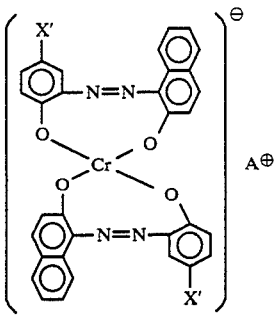

(1)' wherein X' represent Cl or Br and $A^{\oplus}$ is the same as defined as above.

Methods for preparation of toners using the complex salt compounds of this invention include, e.g., a method comprising melt-kneading a mixture of a binder, a charge control agent (the complex salt compound of the formular (1)), a colorant and the like by an apparatus capable of mixing under heating such as a heating kneader, a twin roll or the like, cooling and solidifying the mixture and then pulverizing the solidified mixture to 1–50μ in particle size in a pulverizer such as a jet mill, etc. or a method comprising dissolving a binder in a solvent (e.g. acetone), adding the complex salt compound (charge control agent) and a colorant to the solution, stirring the mixture, then putting it into water to precipitate a crystal, collecting the precipitate by filtration, drying it and pulverizing it to 1–50μ in particle size in a ball mill and the like.

As examples of binders, there may be mentioned polystyrene resins, acrylic resins, styrene-methacrylate copolymers, epoxy resins, etc. and as examples of the colorants, there may be mentioned carbon black, pigments, etc., but this invention is not limited to use of them. Binders and colorants disclosed in U.S. Pat. No. 4147540 may be used. Amount of the complex salt compound used is 0.5–30 parts by weight, preferably 0.5–10 parts by weight for 100 parts by weight of binders. Amount of colorants used is 0.3–30 parts by weight, preferably 0.5–10 parts by weight for 100 parts by weight of binders.

Furthermore, if necessary, a fluidizing agent such as silicon oxide, a antifoggant such as mineral oil, metallic soap, etc. or known charge control agents such as nigrosine dyes may be added to the present toners.

Conspicuous effects of the toners for electrophotographic process of this invention are high chargeability and high charge-durability and further, the compounds of the formula (1) are low value in mutagenicity.

The toners for electrophotographic process by this invention are mixed with carriers such as glass beads, iron powders, aluminum powders or the like normally at a weight ratio of toner:carrier = 1:2–40 and this is used as a developer for electrophotographic process.

This invention is further illustrated by the following examples, wherein "part" is by weight unless otherwise notified.

EXAMPLE 1

Styrene-methacrylate copolymer: 100 parts
Complex salt compound of the following formula (2): 5 parts
Carbon black: 20 parts

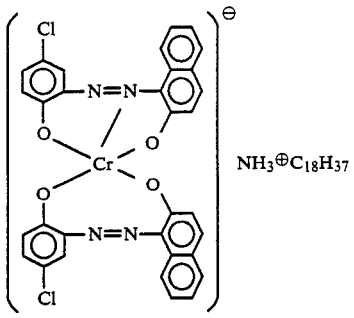

(2)

The above components were mixed and melt-kneaded for 3 hours by a heating kneader. Then, the kneaded product was taken out, solidified by cooling, coarsely ground with a hammer mill, then pulverized in a jet mill having a classification device and classified to a particle size of 1–10μ to obtain toner A.

For comparison, toner B was prepared in the same manner as above except that the complex salt compound represented by the formula (2) was substituted with a complex dye which was not subjected to the salt-forming treatment with stearylamine. Then specific chargeability of toner A (present invention) is compared with that of toner B (known).

Toner A-1 is a sample obtained right after preparation of toner A, and toner B-1 is a sample obtained right after preparation of toner B. And toners A-2 and B-2 are sample obtained from toner A and B by leaving to stand at a humidity of 100% for one week respectively. Each of toners A-1, A-2, B-1 and B-2 was mixed with iron powder of about 200 meshes at a weight ratio of 5:100 (toner:iron powder) to obtain developers A-1, A-2, B-1 and B-2 respectively. Specific chargeability of each developer was measured by Blow-off apparatus (manufactured by Toshiba Chemical Co. Ltd) to obtain the following results.

TABLE 1

| | Specific chargeability ($\times(-10^{-6})$coulomb/g) | |
|---|---|---|
| | Right after prepared (A-1, B-1) | After left to stand at 100% humidity for one week (A-2, B-2) |
| Toner A | 90–100 | 90–100 |
| Toner B (Comparative) | 50–60 | 5–10 |

As is clear from comparison of specific chargeability of toners as right after preparation (A-1, B-1) and after leaving to stand at a humidity of 100% for one week (A-2, B-2), toner A was much superior to toner B in durability of charge.

Copy test:
Styrene-methacrylate copolymer: 100 parts
Complex salt compound of the formula (2): 3 parts
Carbon black: 5 parts The above components were mixed and meltkneaded for 3 hours by a heating kneader. Then, the kneaded product was taken out, solidified by cooling, coarsely ground with a hammer mill, then pulverized in a jet mill having a classification device and classified to a particle size of 1–10μ to obtain toner A-3. Then toner A-4 was obtained by leaving toner A-3 as it was at a humidity of 100% for one week. Toner B-3 was prepared in the same manner as above except that the complex salt compound represented by the formula (2) was substituted with the complex dye ((2)') which was not subjected to the salt-forming treatment with stearylamine (described after). Then toner B-4 was obtained from toner B-3 in the same manner as above.

Developers A-4 and B-4 were obtained by mixing toner A-4 and B-4 with iron powder of about 200 meshes at a weight ratio of 5:100 (toner:iron powder) respectively.

1000 copies were produced by a copying machine (FUJI XEROX 3500) using each of developers A-4 and B-4 to find that toner A-4 gave copies of higher image density and less stain than those obtained by toner B-4. (Comparison was made on the 1000th copies). Therefore toner A was superior to toner B in repetition property in image formation (copying).

The compound used in this example was prepared in the following manner.

10 parts of 4-chloro-2-aminophenol was stirred together with 26 parts of hydrochloric acid and 100 parts of water to dissolve the former, followed by ice cooling to 0°-5° C., addition of 5.1 parts of sodium nitrite and then diazotization by stirring at this temperature for 1 hour. This diazotized product was poured into a solution comprising 150 parts of water, 7 parts of sodium hydroxide and 10.4 parts of β-naphthol at 0°-10° C. to effect coupling reaction and a monoazo compound represented by the following formula was isolated.

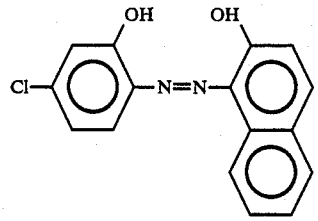

This monoazo compound was stirred together with 500 parts of water, followed by addition of 21.5 parts of sodium chromosalicylate and stirring at 90°-98° C. for 5 hours to perform chromizing. Then, the chromium complex compound represented by the following formula was isolated.

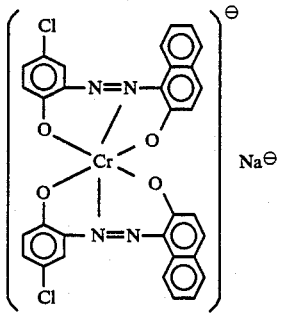

(2)'

This chromium complex compound was stirred at 50°-60° C. together with 400 parts of water and thereto was added a solution prepared by stirring 8 parts of octadecylamine ($CH_3(CH_2)_{16}CH_2NH_2$) with 3.6 parts of hydrochloric acid and 300 parts of water at 80°-85° C. and reaction was effected at 50°-70° C. for 2 hours. PH was adjusted to 7-8 and precipitated crystal was isolated and dried at 90°-100° C. to obtain 28 parts of chromium complex compound in the form of blackish purple powder represented by the above formula (2). Visible absorption spectrum of this chromium complex compound in acetone solvent showed the maximum absorption wavelength of 576 nm.

EXAMPLE 2

Styrene oligomer resin: 100 parts
Complex salt compound of the following formula (3): 10 parts
Carbon black: 20 parts

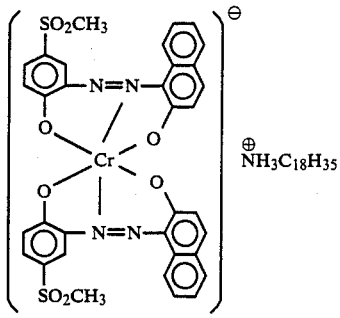

(3)

The above three components were dissolved in 1000 parts of acetone (carbon black was in the form of dispersion), followed by mixing at a room temperature for 2 hours. Then, this mixture was added dropwise to 10,000 parts of water with stirring and then filtration and drying were carried out to obtain a toner in the form of coarse particle. The resulting toner was further milled in a ball mill for 20 hours and classified to 5-10μ (toner C). For comparison, toner D was prepared in the same manner as above except that the complex salt compound of the formula (3) was replaced by the complex dye (3)' which was not subjected to the amine treatment (described after).

Toners C-1, C-2, D-1 and D-2 were obtained and then developers C-1, C-2, D-1 and D-2 were also obtained in the same manner as in Example 1. Developers C-1, C-2, D-1 and D-2 were subjected to the same test as in Example 1 to obtain the following results.

TABLE 2

| | Specific chargeability ($\times(-10^{-6})$coulomb/g) | |
|---|---|---|
| | Right after prepared (C-1, D-1) | After left to stand at 100% humidity for one week (C-2, D-2) |
| Toner C | 70-80 | 70-80 |
| Toner D (Comparative) | 40-50 | 10-20 |

As is clear from the above results, specific chargeability of toner C-2 is equal to that of toner C-1, on the other hand, specific chargeability of toner D-2 is for smaller than that of toner D-1. Therefore toner C is much superior to toner D in durability of charge.

Copy test:
Styrene oligomer resin: 100 parts
Complex salt compound of the formula (3): 3 parts
Carbon black: 5 parts The above three components were dissolved in 1000 parts of acetone (carbon black was in the form of dispersion), followed by mixing at a room temperature for 2 hours. Then the resulting mixture was added dropwise to 1000 parts of water with stirring and then filtration and drying were carried out to obtain a toner in the form of coarse particle size. The resulting toner was further milled in a ball mill for 20 hours and classified to a particle size of 5–10μ to obtain toner C-3. Then toner C-4 was obtained by leaving toner C-3 as it was at a humidity of B 100% for one week. Toner D-3 was prepared in the same manner as above except that the complex salt compound of the formula (3) was replaced by the complex dye (3)′ which was not subjected to the amine treatment (described after). Then toner D-4 was obtained from toner D-3 in the same manner as above.

Developers C-4 and D-4 were obtained by mixing toner C-4 and D-4 with iron powder of about 200 meshes at a weight ratio of 5:100 (toner:iron powder) respectively.

1000 copies were produced by a copying machine (FUJI XEROX 3500) using each of developers C-4 and D-4 to find that toner C-4 gave copies of higher image density and less stain than those obtained by developer D-4. (Comparison was made on the 1000th copies). Therefore toner C is superior to toner D in repetition property in image formation (copy).

The compound of the formula (3) was synthesized as follows: 13.5 parts of 4-methylsulfonyl-2-aminophenol was stirred together with 26 parts of hydrochloric acid and 100 parts of water to dissolve the aminophenol, followed by ice cooling to 0°–5° C., adding 5.1 parts of sodium nitrite and stirring at this temperature for one hour to perform diazotization. The resulting diazotized product was poured into a solution comprising 150 parts of water, 7 parts of sodium hydroxide and 10.4 parts of β-naphthol at 0°–10° C. to effect coupling reaction. Then, a monoazo compound having the following formula was isolated.

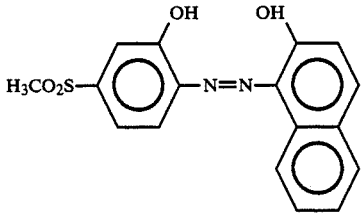

This monoazo compound was stirred with 500 parts of water, followed by adding 21.5 parts of sodium chromosalicylate and stirring at 90°–98° C. for 5 hours to perform chromising. Then, a chromium complex salt compound of the following formula was isolated.

(3)′

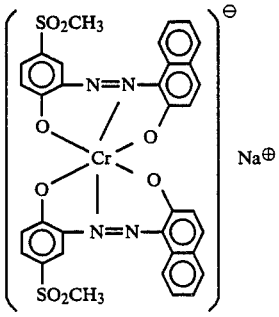

This chromium complex salt compound was stirred with 400 parts of water at 80°–90° C. and thereto was added a solution prerpared by stirring 8 parts of oleylamine ($CH_3(CH_2)_7CH{=}CH(CH_2)_7CH_2NH_2$) with 3.6 parts of hydrochloric acid and 300 parts of water at 80°–85° C. and reaction was carried out at 80°–90° C. for 2 hours. PH was adjusted to 7–8 and reaction product was isolated and dried at 90°–100° C. to obtain 28.5 parts of a chromium complex compound in the form of blackish purple powder. $\nu_{max}$ thereof was 559 nm (in acetone).

EXAMPLE 3

Epoxy resin: 200 parts
Complex salt compound of the following formula (4): B 20 parts
Carbon black: 20 parts (4)

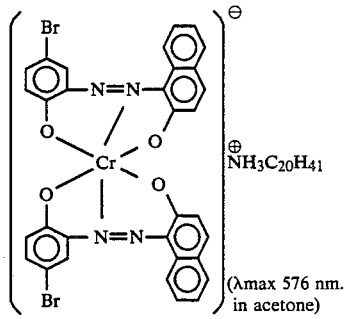

The above components were mixed, then melt-kneaded by a heating twin roll, then cooled and classified with a hammer mill to a particle size of 1–10μ to obtain a toner.

Specific chargeability of the resulting toner was measured in the same manner as in Example 1 to find that the charge-durability of the toner was markedly excellent.

The compound of the formula (4) was synthesized in accordance with the methods in Example 1–2.

EXAMPLES 4–7

Toners were prepared in the same manner as in Example 1 except that complex salt compounds represented by the formulas (5)–(8) were used in place of the complex salt compound of the formula (2) and were subjected to the same tests as in Example 1 to find that all of these complex salt compounds gave toners high charge-durability. These complex salt compounds were synthesized in accordance with the methods in Examples 1–2.

(5)

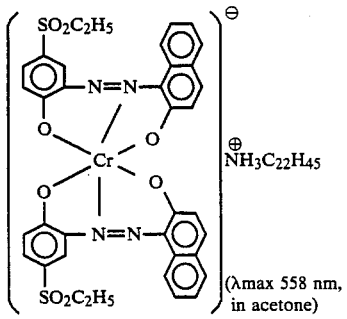

-continued (6)

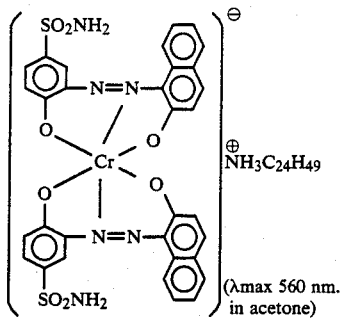

(λmax 560 nm. in acetone)

(7)

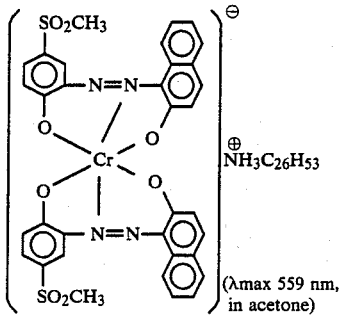

(λmax 559 nm, in acetone)

(8)

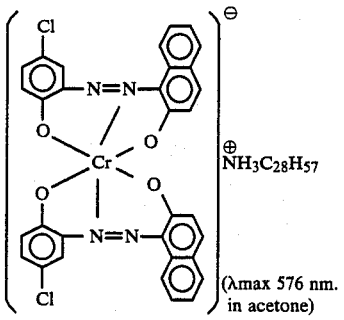

(λmax 576 nm. in acetone)

COMPARATIVE EXAMPLE

Toners G and H were prepared in the same manner as in Example 1 except that complex salt compound represented by the following formulas (9) and (10) were used in place of the complex salt compound of the formula (2). Specific chargeabilities of these toners at right after preparation (G-1, H-1) and after leaving to stand at the humidity of 100% for one week G-2, H-2 were measured.

(9)

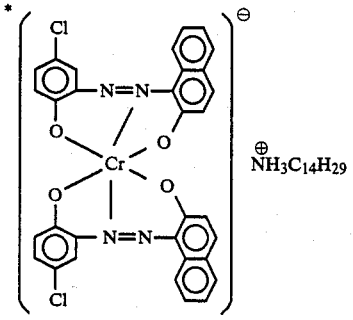

-continued (10)

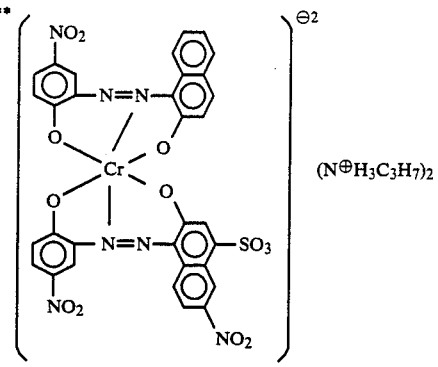

*Dye described in Japanese Patent Kokai (Laid-open) No. 93457/84

**Dye described in Japanese Patent Kokai (Laid-open) No. 35142/81.

TABLE 3

| | Specific chargeability (×(−10⁻⁶)coulomb/g) | |
|---|---|---|
| | Right after prepared (A-1, G-1, H-1) | After left to sand at 100% humidity for one week (A-2, G-2, H-2) |
| Toner A (Example 1) | 90–100 | 90–100 |
| Toner G (Comparative) | 60–70 | 60–70 |
| Toner H (Comparative) | 50–60 | 5–10 |

As is clear from Table 3, toner (A) of this invention was much superior to toner G prepared using the dye which was prepared using an alkylamine of 14 carbon atoms as a salt-forming agent and toner H prepared using other known dye in both the specific chargeability and the durability of charge.

What is claimed is:

1. An electrophotographic toner capable of being electrified negatively comprising (a) a suitable binder; (b) an agent for coloring said toner; and (c) a complex salt compound represented by the following formula (1) :

(1)

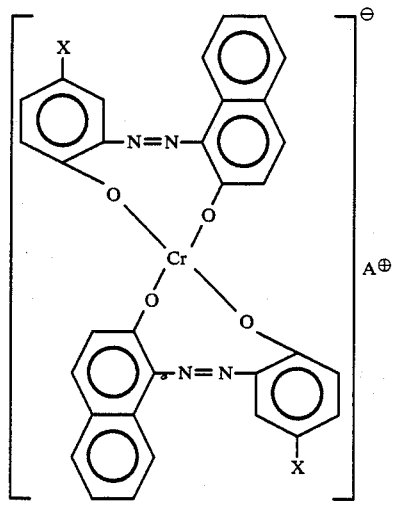

wherein X represents Cl, Br, $SO_2NH_2$, $SO_2CH_3$ or $SO_2C_2H_5$ and A+ represents an alkenyl or alkylammonium ion of 17–28 carbon atoms.

2. The toner of claim 1 wherein said complex salt compound is represented by the following formula

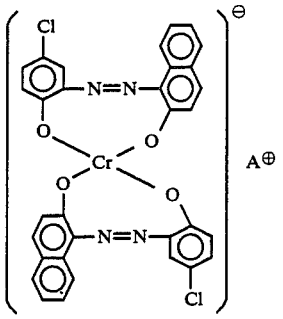

wherein A⊕ is the same as defined in claim 1.

3. The toner of claim 2 wherein said complex salt compound is represented by the following formula:

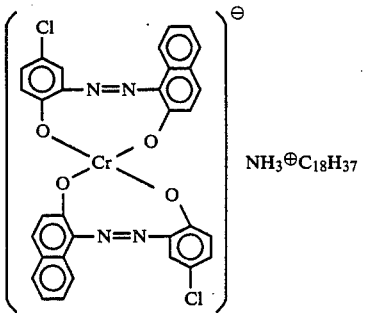

4. The toner of claim 1 wherein said complex salt compound is represented by the following formula:

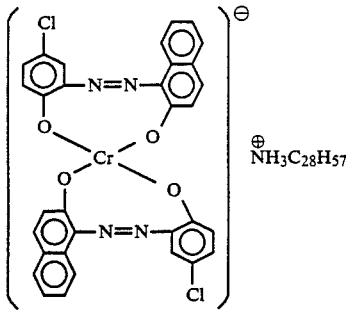

5. The toner of claim 1 wherein said complex salt compound is represented by the following formula

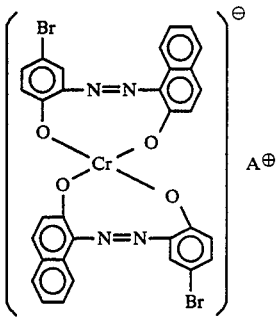

wherein A⊕ is the same as defined in claim 1.

6. The toner of claim 5 wherein said complex salt compound is represented by the following formula;

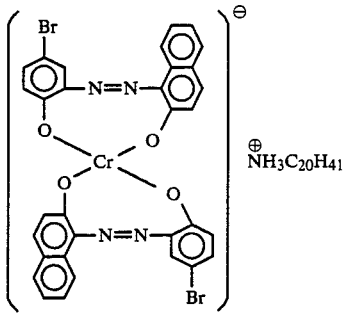

7. The toner of claim 1 which has a particle size of 1–50μ.

* * * * *